United States Patent [19]

Suimon

[11] 4,383,388

[45] May 17, 1983

[54] TOY REMOTE-CONTROL MOTOR BICYCLE

[75] Inventor: Yoshio Suimon, Tokyo, Japan

[73] Assignee: ICD Corporation, Tokyo, Japan

[21] Appl. No.: 244,403

[22] Filed: Mar. 16, 1981

[30] Foreign Application Priority Data

Nov. 26, 1980 [JP] Japan ..... 55-168389[U]

[51] Int. Cl.[3] ..... A63H 30/04; A63H 17/26

[52] U.S. Cl. ..... 46/254; 46/201; 280/279

[58] Field of Search ..... 46/254, 256, 262, 251, 46/213, 201, 202, 211, 206; 180/222, 223, 224; 280/279

[56] References Cited

U.S. PATENT DOCUMENTS 3,546,814 12/1970 Melendez ..... 46/254

3,751,851 8/1973 Nagal ..... 46/206

4,267,663 5/1981 Nagahara ..... 46/254

FOREIGN PATENT DOCUMENTS 1098676 3/1955 France ..... 46/213

*Primary Examiner*—F. Barry Shay

*Attorney, Agent, or Firm*—Flynn, Thiel, Boutell & Tanis

[57] ABSTRACT

A toy remote-control bicycle of the type is disclosed wherein a rear wheel is mounted on the rear portion of a chassis and a front wheel is mounted on the front portion of a chassis via a front fork portion in a manner switchable in either the clockwise or the counterclockwise directions and wherein said front wheel is supported by an improved front wheel mechanism that does not transmit a shock caused by a collision to the directional steering mechanism when the said front wheel collides against an obstacle.

3 Claims, 7 Drawing Figures

TOY REMOTE-CONTROL MOTOR BICYCLE

This invention relates to a remote-control motor bicycle and, more particularly, to a toy remote-control motor bicycle having an improved front wheel support mechanism.

In the prior art, steering of a remote-controlled motor bicycle of this type is controlled either by a motor which is incorporated in the chassis and the rotation of the output shaft of which is transmitted to a member supporting the front wheel via a gear for making the bicycle move straight ahead or turn either left or right, or by a servomotor which is incorporated in the chassis and the output shaft of which is transmitted to a member supporting a front wheel for directional control similar to the above.

Generally, the former motor or a directional switch control means using a gear is used for low-priced toys, whilst the latter or a directional switch control means using a servomotor is used for high-priced toys. The toy remote-control motor bicycle using the servomotor or the directional switch control means using a servomotor, however, has a drawback that the structure of the steering control mechanism tends to be extremely complicated with a large number of parts, thus, pushing up the cost of the final product. In the prior art, the front wheel support mechanism is not provided with any means to soften the shock which might be caused when the front wheel collides againt an obstacle, or even if such means are provided, are not quite satisfactory in the shock absorbing function. Thus, the front wheel collides against an obstacle, the shock tends to be transmitted to the front wheel support member and the steering control mechanism, thereby inflicting damage thereon.

The present invention was conceived to obviate such drawbacks of a toy remote-control motor bicycle having a steering control mechanism with a servomotor, and aims at providing a toy remote-control motor bicycle with a much simpler structure compared with the prior art. The mechanism according to the present invention is safer and more durable because the front wheel support mechanism is improved so that even if the front wheel collides against an obstacle, the shock caused by such collision is not transmitted to the steering mechanism.

Figure 1:
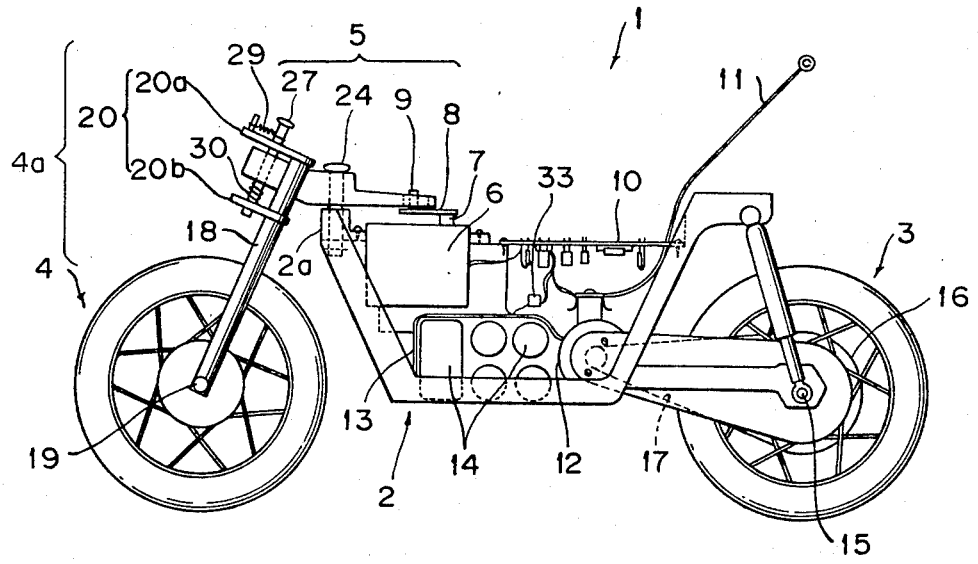
Figure 2:
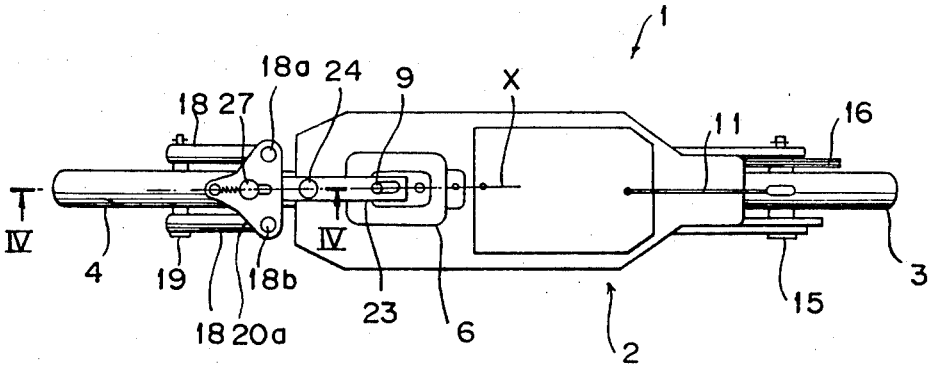
Figure 3:
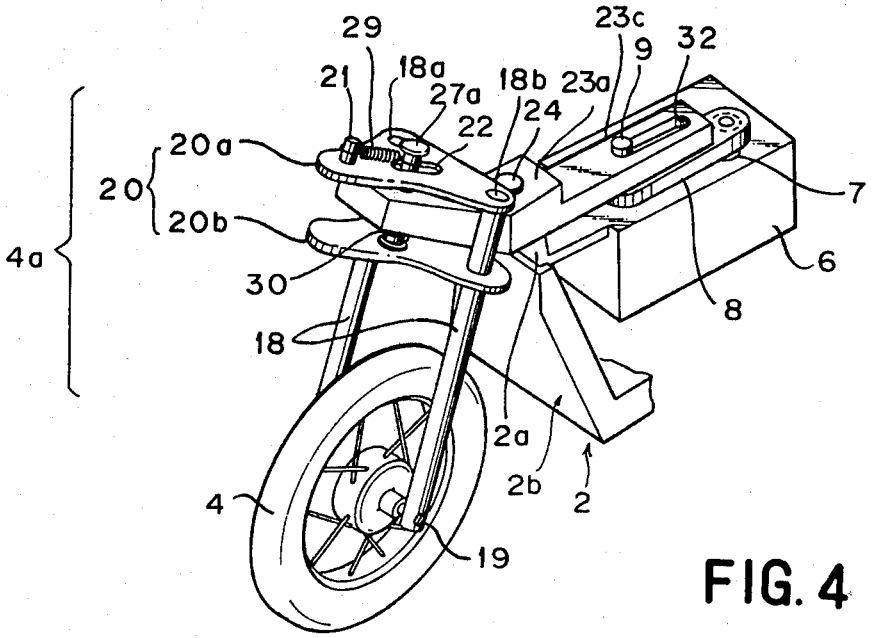
Figure 5:
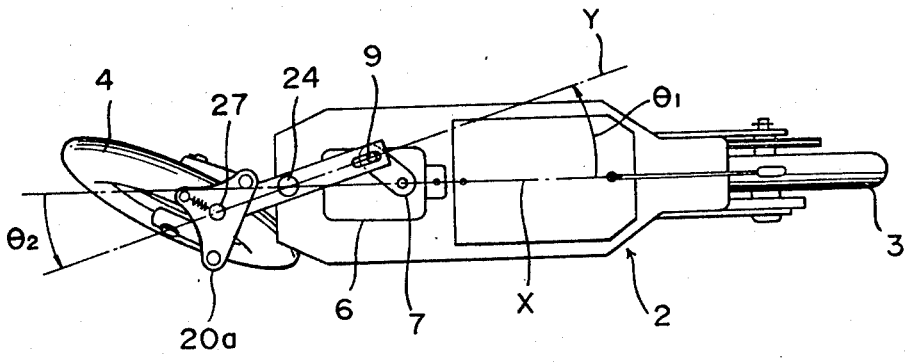
Figure 6:
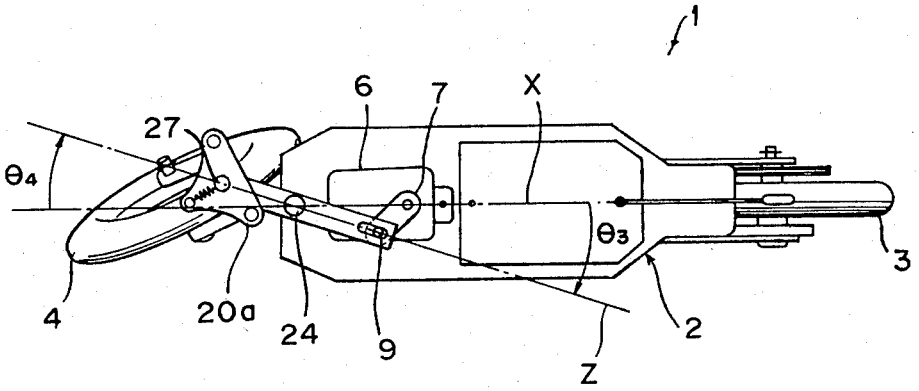

Other objects and advantageous features of the present invention will be readily understood from the detailed descriptions given hereinafter and the attached drawings of a preferred embodiment. In the attached drawings, FIG. 1 is a schematic side view of a toy remote-control motor bicycle, FIG. 2 is the plan view thereof, FIG. 3 is a partially exploded perspective view to specifically illustrate the steering mechanism and the front wheel support mechanism thereof, FIG. 4 is an enlarged cross sectional view taken along the line IV—IV of FIG. 2, FIG. 5 is plan view illustrating a condition when the front wheel is controlled to turn to the right and, FIG. 6 is a plan view illustrating a condition when the front wheel is controlled to turn to the left.

Figure 4:
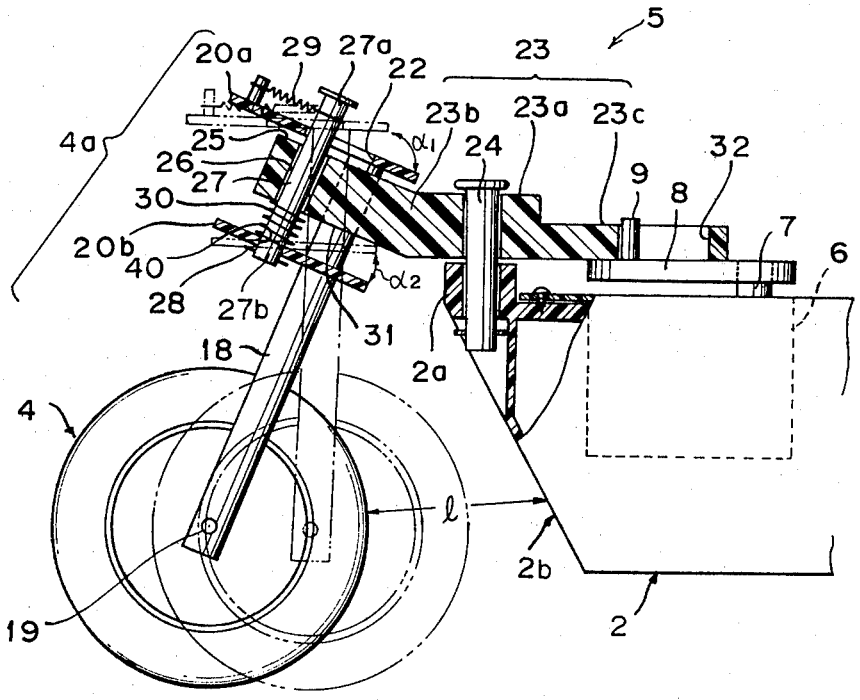
Figure 7:
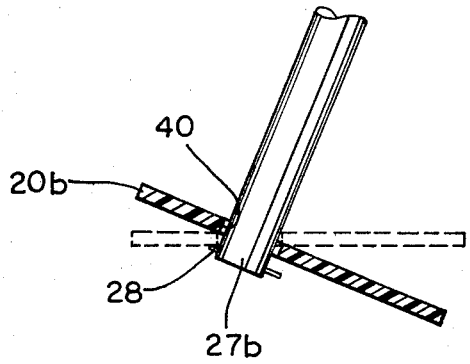

FIG. 7 is an enlarged view of a fragment of FIG. 4.

The present invention will now be explained in detail with reference to the attached drawings.

The toy remote-control motor bicycle 1 according to the present invention mainly comprises a chassis 2, a rear wheel 3, a front wheel 4, a front wheel support mechanism 4*a* and a steering mechanism 5.

A servomotor 6 is mounted on the chassis 2 for switching the direction of movement, i.e. straight ahead, turn to the right or turn to the left. The reference numeral 7 denotes an arcuately movable shaft to which one end of a horizontally arcuately movable arm 8 is fixed. A pin 9 projects upwardly from the other end of the horizontally arcuately movable arm 8.

The servomotor 6 is provided with a printed circuit board 10 which comprises the control circuit therefor. The reference numeral 11 denotes a receiver antenna which is connected to the printed circuit board 10, while 33 denotes a handling switch. The receiver antenna 11 receives signals from the remote-control transmitter (not shown) and transmits them to the servomotor 6 to make the arcuately movable shaft 7 and the horizontally arcuately movable arm 8 turn either to the right or the left. When no signals are transmitted from said remote-control transmitter (not shown), the servomotor 6 is constructed so that the shaft 7 and the arm 8 are returned to their-straight ahead or neutral position from either the left turn position or the right turn position.

The reference numeral 12 denotes a motor for driving the rear wheel 3 which is mounted in the chassis 2. In the chassis 2 there is provided a battery box 13 in which batteries 14 are housed as the power source for the servomotor 6 and the motor 12. In the drawings, a saddle and a carrier seat are omitted from the illustration but they may be formed integrally with the cover to be placed over the chassis 2, and which may be made of materials, such as plastics.

The rear wheel 3 is journalled in a freely rotatable manner on the rear portion of the chassis 2 via a pin 15. A drive wheel 16 is provided integral with the rear wheel 3, the drive wheel 16 being connected to the output shaft of the motor 12 through a rubber belt 17.

The front wheel 4 is journalled in a front steering fork comprised of a pair of rods 18, which comprise part of the front wheel support mechanism 4*a*. The front wheel 4 is freely rotatable on an axle 19 located at and extending between the lower ends of the front fork rods 18. To the upper ends of the rods 18 is fixed a support 20 comprising a pair of support plates 20*a* and 20*b* which also comprise part of the front wheel support mechanism 4*a*. The support plates 20*a* and 20*b* are arranged in parallel, vertically spaced relationship to each other. The steering wheel is omitted from the illustration. The upper support plate 20*a* and the lower support plate 20*b*, are substantially triangular in shape. The plates 20*a* and 20*b* are connected to the upper end portions 18*a*, of the rods 18 at positions close to the two rear corners of said plates (the upper and the lower corners as shown in FIG. 2). More particularly, as indicated in FIG. 3, the upper end portions 18*a*, 18*b* of the fork rods 18,18 are made in the form of a pair of parallel pipes. A pin 21 projects upwardly from the upper support plate 20*a* at a location close to the front corner of the upper support plate 20*a*. The reference numeral 22 denotes an elongated hole which is located at the center of the upper support plate 20*a* and extends in the longitudinal direction thereof. The distance l indicates the distance between the front wheel 4 and the the front portion 2*b* of the chassis 2 in the normal position of said front wheel. The length of the elongated hole 22 is sufficient to permit the front wheel 4 to move between the solid line position thereof and the phantom line position thereof in FIG. 4.

The steering mechanism 5 comprises a directional steering arm 23 and accessory parts thereof. The directional steering arm 23 is journalled in a freely rotatable fashion at the central portion thereof 23*a* to the upper face of the end portion 2*a* of the chassis 2 via the first support shaft 24. The front end portion 23*b* of the directional steering arm 23 is upwardly inclined in the frontward direction and is provided with a through-hole 26 in a direction perpendicular to the inclined face 25 as shown on an enlarged scale in FIG. 4. The second support shaft 27, which comprises part of the front wheel support mechanism 4*a*, extends through the through-hole 26 and also extends through the support plates 20*a* and 20*b*. The upper and lower plates 20*a* and 20*b* re thereby journalled in a freely rotatable fashion to the front end portion 23*b* via said second supporting shaft 27. Referring now to FIG. 3, the front end portion 23*b* of the directional steering arm 23 extends between the upper and the lower support plates 20*a* and 20*b* and between the upper portions 18*a* and 18*b* of the fork rods 18. The second support shaft 27 extends through the slot 22 in the upper support plate 20*a*, through the through-hole or bore 26 in the front end portion 23*b* of the steering arm 23 and thence through a hole 40 downwardly to a position beneath the lower supporting plate 20*b*. The lower end 27*b* of the second supporting shaft 27 is fixed against removal from the lower supporting plate 20*b* by a retainer ring 28. The through-hole 40, which is provided approximately at the midpoint of the lower support plate 20*b* has a diameter larger than that of the support shaft 27, as shown in FIG. 7. Thus, the support plate 20*b* can move through a verical arc $\alpha_2$, relative to the support shaft 27, between the solid line position and the phantom line position thereof, as shown in FIG. 4. The upper end portion 27*a* of the second shaft 27 projects above the upper supporting plate 20*a*. One end of a first tension spring 29 is connected to the pin 21 projecting above the front end of the upper face of the upper support plate 20*a*, while the other end thereof is connected to the upper end 27*a* of the second supporting shaft 27. The first spring 29, which comprises part of the front wheel mechanism 4*a*, is used to maintain stability of the supporting plate 20 with respect to the front end portion 23*b* of the directional steering arm 23. It also has the function of softening the shock caused when the front wheel 4 collides against an obstacle (not shown). The upper support plate 20*a* is pulled by the first spring 29 constantly toward the right (or rearwardly) as indicated in FIG. 4 to urge the front rods 18 and the front wheel 4 to be positioned in the opposite (forward) direction. Furthermore, the second supporting shaft 27 is further provided with a second spring 30, which is in compression whereby to absorb shock. More specifically, the second spring 30 is provided on the lower end 27*b* of the second supporting shaft 27 in the space between the lower face 31 of the front end 23*b* of the directional steering arm 23 and upper face of the lower supporting plate 20*b* to absorb vibration or shock which might be transmitted from the front wheel 4 to the fork rods 18 and the lower support plate 20*b*.

The rear portion 23*c* of the directional steering arm 23 has an elongated hole 32 which extends in the longitudinal direction thereof. The pin 9 projecting at the end of the said horizontally rotating arm 8 is received within the elongated hole 32.

The operation of the toy remote-control motor bicycle will be explained hereinafter. When the motor bicycle is to advance straight ahead, the shaft 7 of the servomotor 6 and the arm 8 are set at their neutral positions and the positions of the pin 9 and the second supporting shaft 27 with respect to the first supporting shaft 24 lie along the straight line marked with the letter X in FIG. 2. When the direction of movement of the bicycle is to be changed to the right, a corresponding signal is transmitted from a remote-control transmitter (not shown), and is received by the receiver antenna 11 which gives a driving signal to servomotor 6 through the printed circuit board 10. The shaft 7 of the servomotor 6 is made to move through a clockwise arc to make the arm 8 also move clockwise similarly so that the pin 9 is moved within the elongated hole 32, thereby rotating the directional steering arm 23 counterclockwise around the first supporting shaft 24. Referring to FIG. 5, the angle of displacement $\theta_1$ of the directional steering arm 23 is equivalent to the stroke required to move the pin 9 from the one end to the other end of the elongated hole 32. Accordingly the front end 23*b* of the directional steering arm 23 is made to rotate through the angle $\theta_2 \cdot [\theta_1 = \theta_2]$.

Simultaneously the supporting plates 20, the front rods 18 and the front wheel 4 are moved clockwise through the angle $\theta_2$ (as shown in FIG. 5) through the second supporting shaft 27. Under such conditions, the straight line Y on which the pin 9, the first supporting shaft 24 and the second supporting shaft 27 are located is at a position rotated through the angle $\theta_2[\theta_1 = \theta_2]$ from the central line X of the chassis 2, whereby the center of gravity of the chassis 2 is displaced above the direction of the central line X as appearing in FIG. 5, thus inclining the whole body of the toy remote-control motor bicycle 1 in the upward direction shown in FIG. 5. This makes the front wheel 4, the front rods 18 and the supporting plates 20 rotate clockwise around the second supporting shaft 27 in order to correct the condition caused by the displacement by the angle $\theta_2$. Therefore, the whole body of the motor bicycle 1 is directed to advance towards the right as shown in FIG. 5.

When the direction of advance has been changed, a signal is given to the servomotor 6 to restore straight-ahead direction by rotating the horizontally rotating arm 8 to the position opposite to the one described above so that the directional steering arm 23 is rotated around the first supporting shaft 24 by means of counterclockwise rotation of the pin 9 to position the pin 9, the first supporting shaft 24 and the second supporting shaft 27 on the central line X of the chassis 2. Accordingly, the front wheel 4 is returned to the straight-ahead position so that the motor bicycle 1 proceeds straight ahead. If a signal to turn to the right is continuously transmitted from the remote-control transmitter (not shown), the front wheel 4 maintains the state shown in FIG. 5 without restoring the previous straight-ahead state, making the motor bicycle 1 run on a predetermined circular track to the right.

When the motor bicycle 1 is made to turn to the left, or the direction opposite to the case above, the positions of the pin 9, the first supporting shaft 24 and the second supporting shaft 27 are brought to the positions on the straight line Z displaced from the central line X of the chassis 2 by the revolution angles $\theta_3$ and $\theta_4[\theta_3 = \theta_4]$ through operation opposite to those described above. The front wheel 4 is rotated around the second supporting shaft 27 counterclockwise, driving the whole body of the motor bicycle 1 to the left as shown in FIG. 6. Further detailed explanation will be omitted since the operation of the steering mechanism 5 is substantially similar to the one described above except that the direction is opposite to the direction in the case described above.

The shock-absorbing function of the front wheel supporting mechanism 4*a* will now be explained hereinbelow. If the front wheel 4 happens to collide against an obstacle (not shown) while advancing, the front wheel 4 is displaced rearwardly to the position indicated by the phantom lines in FIG. 4. This occurs because the second supporting shaft 27 which extends through the front end portion 23*b* of the steering arm 23 in a vertical direction is held in a substantially fixed state under such conditions, while the support plates 20*a* and 20*b* are allowed to move. Therefore, the upper support plate 20*a* is moved forwardly (or to the left in FIG. 4) against the pulling force of the first spring 29 within the scope of the length of the elongated hole 22 as indicated in FIG. 4. This movement is expressed in reality in FIG. 4 as the angle $\alpha_1$ (the rotation angle of the upper support plate 20*a*) and the angle $\alpha_2$ (the rotation angle of the lower support plate 20*b*).

The impact generated from the shock at collision against an obstacle (not shown) works not only to push the front wheel 4 rearwardly (or to the right in FIG. 4) but also to push it upwardly against the effect of the second compression spring 30, which thus absorbs the impact force which acts to push up the wheel.

As described in the foregoing, the present invention enables a motor bicycle to be steered without risk of it toppling over. Moreover, the front wheel mechanism according to the present invention is advantageous in that the impact force is not transmitted to the front fork or the directional steering arm, thus preventing damage to or failure of the front fork portion, the directional steering arm or the servomotor. So even if the front wheel thereof happens to collide with an obstacle while advancing, and the front wheel is made to recede rearward, the impact force generated by this rearward movement is absorbed by the first tension spring 29 while the force pushing the front wheel upward is absorbed by the second compression spring 30.

Therefore, the present invention provides a toy remote-control motor bicycle at a lower cost with performance equal or superior to similar conventional bicycles, which bicycle also has a smaller number of parts and is safer and more durable.

What we claim:

1. In a toy, remote-controlled, motor-driven bicycle including an elongated chassis, a rear wheel rotatably mounted on the rear portion of said chassis, a steerable front wheel rotatably mounted on the front portion of said chassis, a motor for driving said bicycle, power-supply means for operating said motor, remote control means for receiving external signals and controlling the direction of movement of said bicycle in response thereto, a steerable front-wheel support mechanism rotatably supporting said front wheel, means connecting said front-wheel support mechanism to said chassis and adapted for steering said bicycle by effecting steering movement of said front-wheel support mechanism in unison with said front wheel, the improvement which comprises: said front-wheel support mechanism comprises a steering fork having, at its lower end, an axle on which said front wheel is mounted for rotation; an upper support plate and a lower support plate both fixedly mounted on the upper portion of said steering fork in parallel, vertically spaced-apart relation, said upper support plate having a first, centrally located, through-hole which is elongated in the lengthwise direction of said chassis, said upper support plate having a pin projecting upwardly from its upper surface and located in front of the forward end of said first through-hole, said lower support plate having a second, centrally located, through-hole positioned below and in vertical alignment with said first through-hole; said means for effecting steering movement of said front-wheel support mechanism comprising a directional steering arm extending forwardly from the upper side of said chassis at the front end thereof and a first support shaft supporting said steering arm for pivotal movement with respect to said chassis about a vertical axis, the forward end portion of said directional steering arm extending between said plates and having a bore therethrough which is vertically aligned with said first and second through-holes; an upright, second support shaft extending upwardly through said second through-hole, said bore and said first through-hole, said second support shaft having an upper portion projecting above the upper surface of said upper support plate; a first, tension spring connected between said pin and said upper portion of said second support shaft for resiliently yieldably continuously urging said upper portion of said second support shaft to the forward end of said elongated first through-hole, said second through-hole slidably receiving the lower end of said second support shaft so that said second support shaft can pivot forwardly and rearwardly with respect to said lower support plate.

2. A toy, remote-controlled, motor-driven bicycle as claimed in claim 1 including a second compression spring mounted in association with said second support shaft between the lower surface of the forward end portion of said directional steering arm and the upper surface of said lower support plate for resiliently yieldably urging said lower support plate downwardly relative to said directional steering arm.

3. A toy, remote-controlled, motor-driven bicycle as claimed in claim 1 or claim 2 in which said forward end portion of said directional steering arm is inclined upwardly in a direction forwardly of said chassis, said steering fork comprises two upright parallel posts which are fixed to and extend perpendicularly to said upper and lower support plates, said second support shaft extends perpendicular to the forward end portion of said directional steering arm, said posts and said upper and lower support plates being mounted for joint, reversible, pivotal movement with respect to said forward end portion of said directional steering arm between an inclined first position in which said upper and lower support plates extend substantially parallel with said forward end portion of said directional steering arm and the upper portion of said second support shaft is located at the forward end of said elongated first through opening and a second position in which said upper and lower support plates extend substantially horizontally and the upper portion of said second support shaft is located at the rearward end of said elongated first through opening.

* * * * *